United States Patent [19]

Grecksch et al.

[11] Patent Number: 4,921,180

[45] Date of Patent: May 1, 1990

[54] PACKAGE TRANSFERRING MEANS FOR A TEXTILE WINDING MACHINE

[75] Inventors: Hans Grecksch, Monchengladbach; Josef Bertrams, Wegberg; Wolfgang Loers, Monchengladbach, all of Fed. Rep. of Germany

[73] Assignee: W. Schlafhorst & Co., Fed. Rep. of Germany

[21] Appl. No.: 240,743

[22] Filed: Sep. 2, 1988

[30] Foreign Application Priority Data

Sep. 5, 1987 [DE] Fed. Rep. of Germany ..... 3729777

[51] Int. Cl.[5] ..... B65H 67/04

[52] U.S. Cl. ..... 242/35.5 A; 242/35.5 R

[58] Field of Search ..... 242/35.5 A, 35.5 R, 242/58.6

[56] References Cited

U.S. PATENT DOCUMENTS

| | | | |
|---|---|---|---|
| 3,820,730 | 6/1974 | Endo et al. | 242/35.5 A X |
| 4,418,522 | 12/1983 | Harrop et al. | 242/35.5 R X |
| 4,657,194 | 4/1987 | Wey et al. | 242/35.5 A |
| 4,690,342 | 9/1987 | Langen | 242/35.5 A |

FOREIGN PATENT DOCUMENTS

| | | | |
|---|---|---|---|
| 1190510 | 5/1970 | United Kingdom | 242/46 |
| 2179064 | 2/1987 | United Kingdom | 242/35.5 A |

*Primary Examiner*—Stuart S. Levy
*Assistant Examiner*—E. Dunlap
*Attorney, Agent, or Firm*—Shefte, Pinckney & Sawyer

[57] ABSTRACT

A housing is mounted on a column outwardly of a package conveyor at the rear of the machine. A pair of support arms are connected to gears of a gear assembly in the housing and extend at a downward inclination inwardly toward the machine. One of the arms is mounted above the other arm and is longer so that package supporting rods extending from the ends of the support arms will be substantially parallel in a generally horizontal plane for receipt of packages positioned thereon at the winding station. The housing is vertically movable to lower the support arms for deposit of the package onto the conveyor. The support arms pivot through arcs sufficiently long to clear the rods of the package upon raising of the housing and connected support arms into position for receipt of the next package. A synchronization shaft connects the gear assemblies at the other winding stations for synchronous operation of pivoting of the support arms, and a synchronization belt extends along the machine for synchronized raising and lowering of the housing and support arms at all of the winding stations.

16 Claims, 6 Drawing Sheets

PACKAGE TRANSFERRING MEANS FOR A TEXTILE WINDING MACHINE

BACKGROUND OF THE INVENTION

The present invention relates to a textile winding machine having package transferring means. A known textile winder having package transferring means is disclosed in German Offenlegungschrift No. 35 11 735 wherein a selectively operable package conveyor belt runs lengthwise along the textile machine. This textile machine also includes a vertically movable temporary storage frame which can temporarily store a wound pacakge above the conveyor belt and thereafter lower the wound package onto the conveyor belt when the belt again has room to accept wound packages. A transfer device at the winding station transfers the wound packages from the winding station to the vertically movable temporary storage frame. However, the need to provide a transfer apparatus on the winding station itself to transfer wound packages to the temporary storage frame above the belt limits the adaptability of the disclosed package transfer system to existing textile winding machines. Accordingly, the need exists for a package transfer means which is easily adaptable to new and existing textile machines which provides the temporary storage capability for storing a wound package above the package conveyor belt until the package conveyor belt has been unloaded.

SUMMARY OF THE INVENTION

The present invention provides a package transferring means which is especially economical and effective. Briefly described, the means for transferring wound packages is incorporated in a textile winding machine having a package conveyor and includes a supporting frame and package supporting means mounted on the frame above the conveyor. The supporting means includes a pair of support arms with package supporting member on each arm for supporting a package thereon. Means are provided for moving the package supporting means generally vertically on the supporting frame to lower a supported package onto the conveyor and to move subsequently upwardly away from the carrier. Means are also provided for oppositely pivoting the arms away from each other to release a supported package onto the conveyor.

Preferably, the supporting frame is disposed laterally on the conveyor and the support arms extend from the frame over the conveyor with one of the support arms being longer than the other to dispose the supporting members in package supporting disposition over the conveyor. Preferably, the support arms extend at a downward inclination from the supporting frame to the package supporting members so that pivoting of the support arms will result in an opening of the package supporting members for release of a supported package onto the conveyor. The support arms are preferably connected to the pivoting means with the longer support arm being connected above the connection of the other support arm and the pivoting means pivoting the longer support arm in a longer arc than the other support arm.

The means for oppositely pivoting the support arms preferably includes a motor and a gear assembly driven by the motor with a synchronization shaft coupled to the gear assembly of another package transferring means on the winding machine, and the gear assembly includes a gear coupled to each of the support arms, with the gears being in meshing contact with each other.

In the preferred embodiment, the supporting frame is disposed outwardly of the conveyor at the rear of the machine such that the support arms project inwardly of the machine and means are provided for vertically moving the supporting frame. Means are also provided for sychronously coupling the means for vertically moving the supporting frame with means for vertically moving a supporting frame of another package transferring means on the winding machine and the means for sychronously coupling comprises an endless belt. The package conveyor may be supported on the machine frame and the supporting frame also supported on the machine frame.

Further, in the preferred embodiment the package supporting members are in the form of generally horizontally extending rods for supporting a package thereon, with the rods extending generally parallel to each other. The pivoting means oppositely pivots the support arms sufficiently for the rods to clear the package to avoid contact therewith during upward movement of the package supporting means.

By the present invention the package transferring means is operable from above the package conveyor without interference with or requiring modification of other operable parts of the machine and requiring relatively little space on the machine. In this regard, the invention does not require installation on both sides of a package conveyor nor under the package conveyor. It is also applicable to installation on a broad range of machines.

In the preferred embodiment, with the support arms being of different lengths and extending at a downward inclination, the support arms are pivoted in a jaw-like fashion to release the package so that the package transferring means can be lifted clear of the released package without delay to the height at which the support arms can then reassume their package receiving positions. Also, the apparatus of the preferred embodiment requires only relatively little space in which to operate.

Other and further features and advantages of the present invention will be apparent from the accompanying drawings and the following detailed description of the preferred embodiments.

DETAILED DESCRIPTION OF PREFERRED EMBODIMENT

Figure 1:
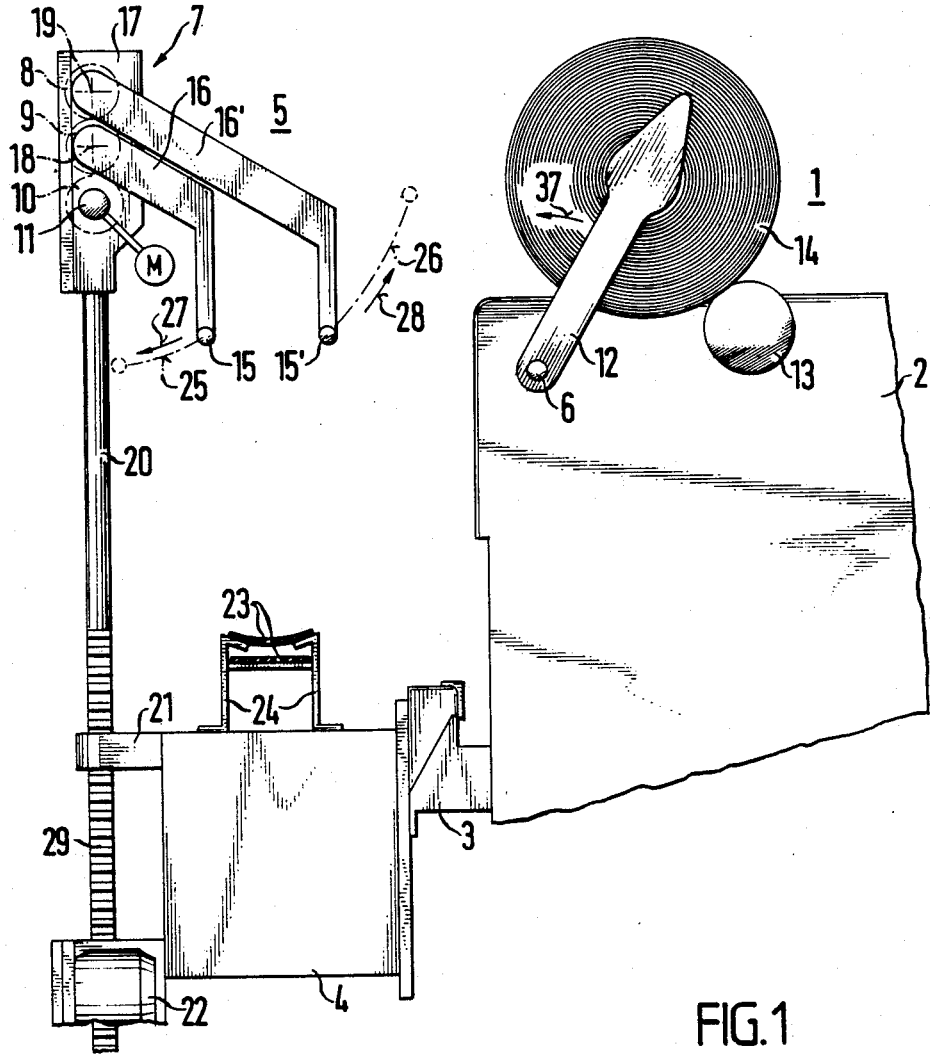
FIG. 1 is a side elevational view of a portion of one winding station of a textile winding machine, showing the package transferring means of the present invention installed adjacent a package conveyor and showing a package supported on a spindle prior to being transferred.

As shown in FIG. 1, a textile winding machine 1 has a number of winding stations aligned in a row, of which only the forwardmost station 2 is shown in FIG. 1, the other stations being identical to the one illustrated. Each station 2 is mounted on supports 3 to a machine frame 4 which serves as the support for a package conveyor in the form of a belt 23. Support brackets 24 project from the top of the machine frame 4 to support the package conveyor 23. Positioned above the package conveyor belt 23 is a controllable, vertically movable package transferring means 5 according to the preferred embodiment of the present invention.

At the winding station 2 a yarn driving drum 13 guides yarn onto a package 14 and drives the package 14 by frictional engagement. The package 14 is rotatably secured on a spindle 12 that is pivoted about an axis 6.

The package transferring means 5 is adapted to temporarily receive a package and to suspend it above package conveyor belt 23. For this purpose, the package transferring means 5 includes support members, in the form of two horizontally extending parallel rods 15 and 15' for supporting and carrying a package. These rods 15 and 15' re oriented parallel to the package conveyor belt 23 and are longitudinally aligned with corresponding rods of package transferring means at the other winding stations. Further, these rods 15 and 15' are connected at one end to support arms 16 and 16', respectively.

The support arms 16 and 16' are rotatably connected to a housing from which the support arms 16 and 16' are driven and controlled. The housing 17 is supported on the top of a supporting frame or column 20 and houses gear assembly 7 that includes gears 8,9 and 10 arranged vertically above one another. A synchronization shaft 11 is connected to the gear assembly 7 and connects the vertically lowest gear 10 to the corresponding gears at the other winding stations so that the operation of the gear assemblies at all of the winding stations are synchronized. The synchronization shaft 11 is driven by a motor M, shown only in FIG. 1.

The support arm 16 is coupled to the gear 9 for rotation therewith about an axis 18, with the gear 9 being in meshing engagement with the other gears 8 and 10. The support arm 16' is coupled to the gear 8 for rotation therewith about an axis 19.

The support arms 16 and 16' extend at a downward inclination from the housing 17 with one arm 16' mounted above the other arm 16 and being longer so that the rods 15' and 15 at their respective ends are disposed generally in the same horizontal plane for common support of a package 14 over the conveyor belt 23. Additionally, the support arms 16 and 16' are arranged such that the rod 15 on the support arm 16 rotates or pivots in an arcuate path 25 toward the left (as seen in FIG. 1) while the rod 15' on the support arm 16' pivots in a correspondingly greater arc 26 to the right. The rod 15 thus swings along arcuate path 27 while rod 15' swings along arcuate path 28. Both rods are swingable back along their respective arcuate path 27 and 28 to return to their initial positions. In this arrangement, axis 19 of the longer support arm 16' is above the axis 18 of the shorter support arm 16.

As shown in FIG. 1, the column 20 is positioned outwardly of the conveyor belt 23 at the rear of the textile machine 1 so that the support arms 16 and 16' project inwardly towards the winding station 2. Column 20 is movably supported in a flange 21 secured to the machine frame 4, whereby the column 20 is movable upwardly and downwardly. A gear assembly below the flange 21 includes a gear with internal threads cooperating with external threads 29 on the column 20 so that rotation of the gear 22 causes column 20 to move upward or downward for adjustment of the operating height of the support arms 16, 16' to accommodate different size packages.

Figure 7:
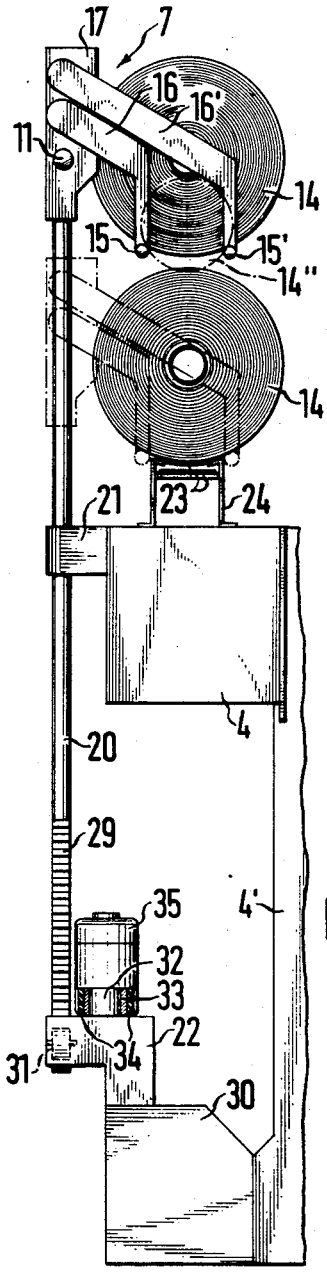
FIG. 7 is a view similar to FIG. 3 illustrating a modified embodiment of the present invention.

While the preferred embodiment shown in FIGS. 1–6 includes the gear 22 coupled to the machine frame 4, the gear assembly can be differently constructed and supported, for example as shown in FIG. 7, wherein the gear assembly 22 is mounted on a channel 30, which is connected by a component 4' of the machine frame 4.

A driven gear 31 mounted on the gear assembly 22 and drivingly connected to a drive shaft 32 of the gear assembly 22 is in threaded engagement with threads 29 on the column 20. The drive shaft 32 of the gear assembly 22 also rotates a gear 33 to which an endless belt 34 is connected. The endless belt 34 extends in driving engagement with corresponding gears of package transferring means at the other winding stations. Thus, the belt and gears serve as means for synchronously coupling the vertical moving means at all winding stations.

The drive shaft 32 of gear assembly 22 is driven by a motor 35. The corresponding gears of the gear assemblies at the other winding stations are driven by the endless belt 34 or could be individually driven by additional motors.

It is to be understood that the synchronization of the respective columns and driving heads of the package transferring means of the package stations 2 can be accomplished with other known mechanisms. For example, synchronization can be accomplished by electric motor drives through commonly controlled step motors, electric shafts or the like. However, mechanical synchronization possesses certain advantages in view of its reliability and, for this reason, the preferred embodiment has been illustrated with such mechanical synchronization mechanisms.

FIG. 7 illustrates how a package 14, which is supported on the horizontal rods 15 and 15', is brought to the package position 14' on the package conveyor belt 23, by the lowering of the column 20. Once package 14 has been lowered to the position 14', column 20 can be lowered further so that rods 15 and 15' are below the package now supported on the conveyor belt 23 and the rod 15' can be oppositely pivoted clear of interference with the package upon raising of the support arms. Once column 20 has been moved to its uppermost position, the rods 15 and 15' can be returned to their initial package receiving positions.

As seen in FIG. 7, rods 15 and 15' are able to handle the packages 14'' of relatively small diameters (shown in broken lines) without adjustment of the support arms 16 and 16' or the rods themselves. However, the rods 15 and 15' are preferably initially positioned to receive packages 14 of maximum diameter.

The operation of package transferring means 5 is as follows. As soon as the package 14 has reached its desired diameter or yarn capacity, the package is set onto rods 15 and 15'. This can be accomplished, for example, by swinging the package spindle 12 in the direction of the arrow 37 so that the package 14 is suspended above the rods 15 and 15'. Then, the spindle frame can be opened so that the package 14 is released from the spindle 12 onto the rods 15 and 15'. Then, the package spindle 12 can be swung back to its initial position to receive an empty package core and start the winding of a new package.

The deposit of the package 14 from the spindle 12 onto the rods 15 and 15' can be accomplished with an automatic package exchange apparatus or can be accomplished by hand.

Figure 2:
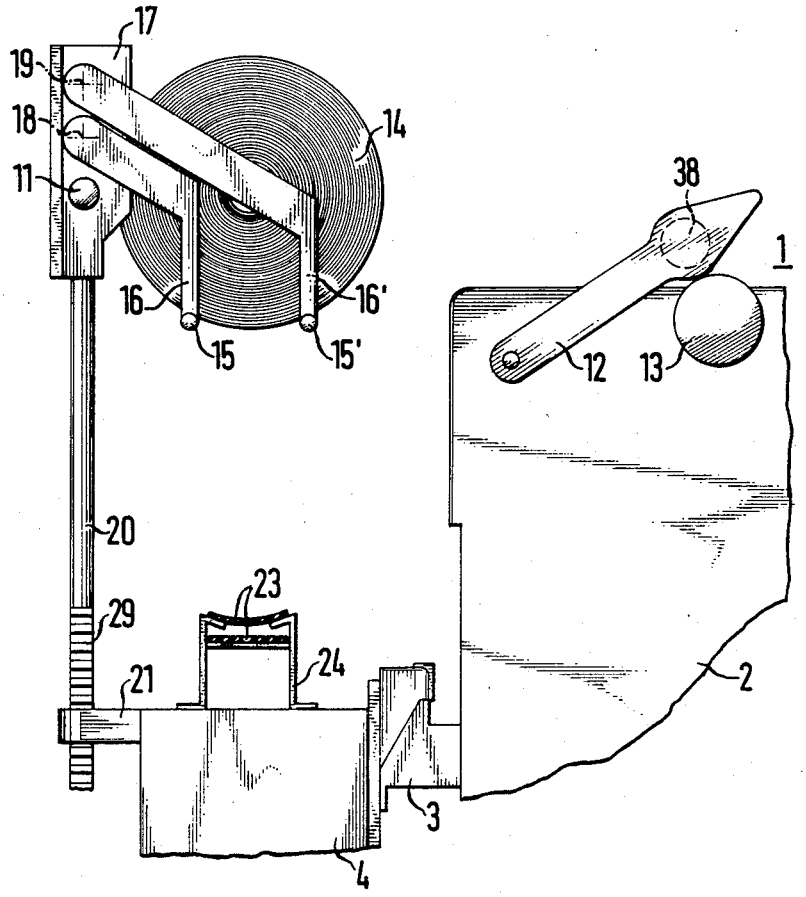
FIG. 2 is a view similar to FIG. 1, showing a package supported on the package transferring means of the present invention.

FIG. 2 shows the package 14 received on the rods 15 and 15' and the package spindle 12 holding a new empty package core 38 in winding position.

Figure 3:
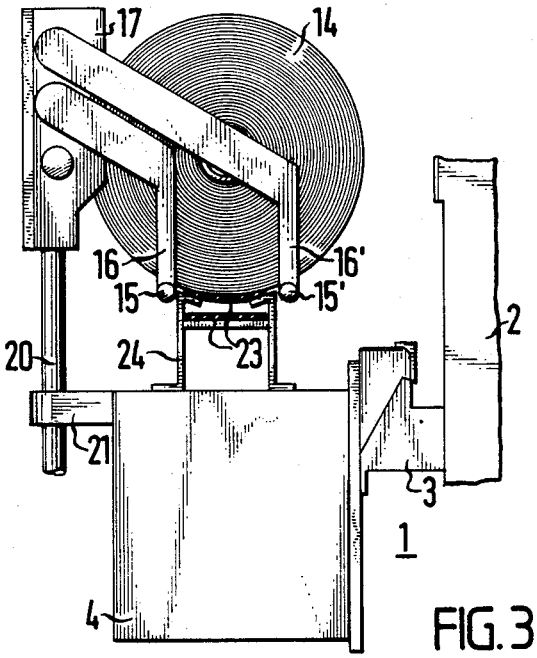
FIG. 3 is a view of a portion of FIG. 1, showing the package transferring means lowered to position the package on the package conveyor.

As shown in FIG. 3, the column 20 can be lowered to such an extent that the package 14 comes to rest on the conveyor belt 23.

Figure 4:
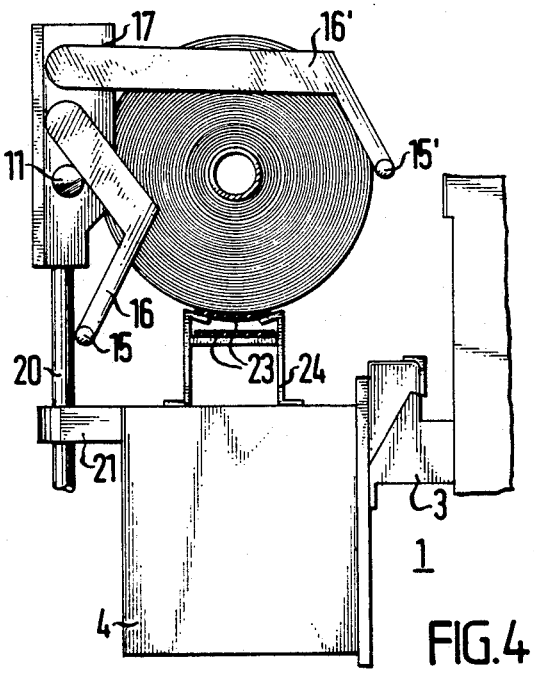
FIG. 4 is a view similar to FIG. 3, showing the pair of support arms in position after having released the package onto the package conveyor.
Figure 5:
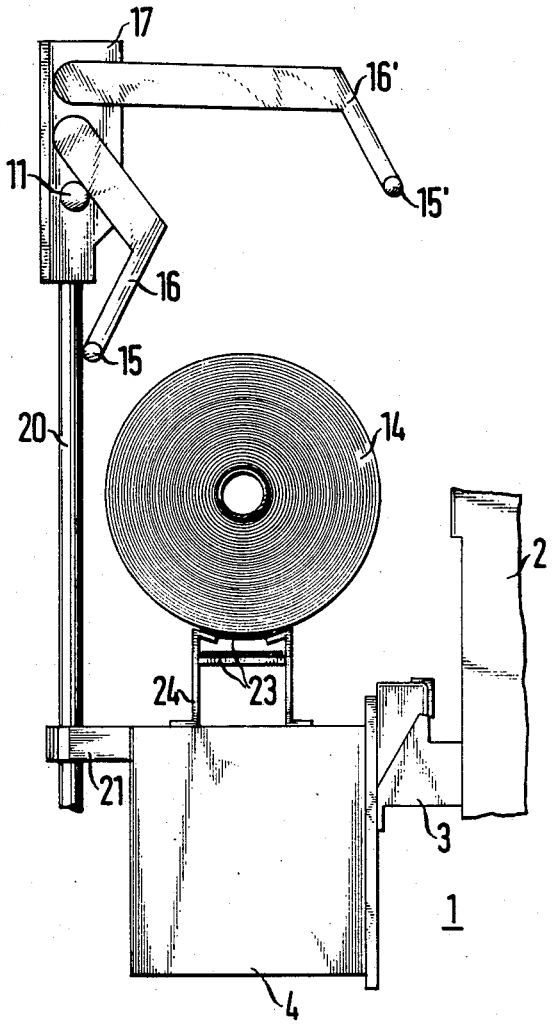
FIG. 5 is a view similar to FIG. 3, showing the package transferring means raised to its package receiving position after having released a package on the package conveyor and showing the support arms in their open, package-release positions.
Figure 6:
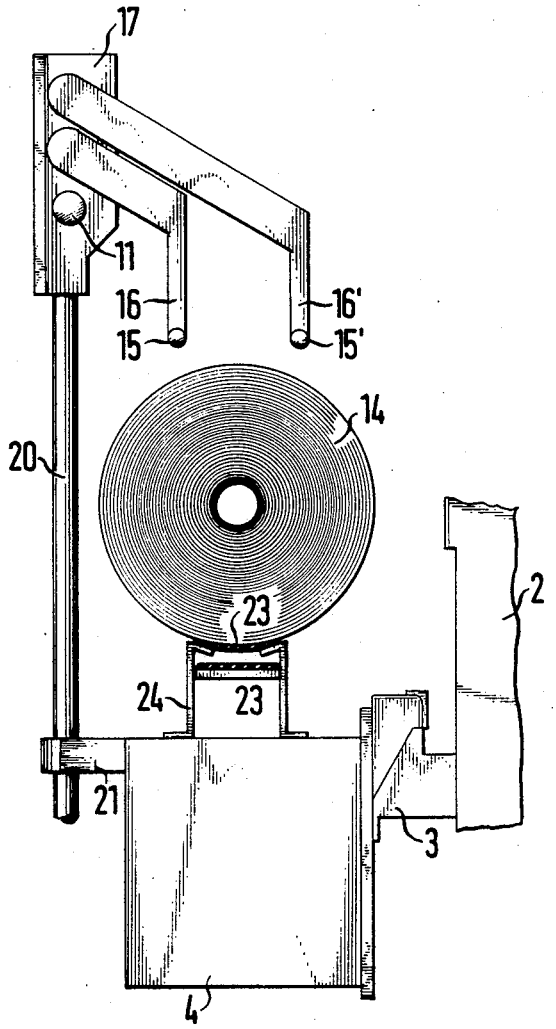
FIG. 6 is a view similar to FIG. 5, showing the support arms closed in their package receiving position.

As shown in FIG. 4, the support arms 16 and 16' can be swung through their respective arcs such that the rods 15 and 15' are swung beyond the width of the package 14 so that when the column 20 is moved upward again, such as shown in FIG. 5, the rods 15 and 15' clear the package 14. As soon as the package 14 has been deposited on the package conveyor belt 23 and the support arms 16 and 16' have been swung away, the package conveyor belt 23 can be operated to transport the packages 14 to an end of the textile machine 1 where they can be transported further or otherwise processed further. The rods 15 and 15' can receive a new package 14 while the package conveyor belt 23 operates independently.

As shown especially in FIG. 7, the arrangement of a number of package transferring means 5 in a row offers certain advantages. For example, there is typically room above the package conveyor belt 23 for additional package storage. Thus, installation of columns 20 on an existing textile winding machine does not pose any difficult problems. In view of available space, and because of the opportunity for package storage, it is advantageous to arrange the support arms 16 and 16' so that they are oriented diagonally downwardly towards the textile machine 1. For the same reasons, it is advantageous to position the drive mechanism for the column 20 beneath the housing 17.

The operation of the package transferring means 5 so that the packages are first received by the transferring means and then transferred to the package conveyor belt 23 produces several advantages. The installation of the empty package cores can be carried out while the package conveyor belt is operating so that, for example, the automatic core installation apparatuses need not be stopped while the package conveyor operates. For the same reason, it is not necessary that any particular winding station be out of operation for an unnecessary length of time while awaiting an empty core. The clearing of various package types from the textile machine 1 can thus be rapidly accomplished without the undesired mixing of different package types.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile winding machine of the type having a package conveyor, means for transferring wound packages to the conveyor, comprising:

a supporting frame located laterally of the conveyor;

package supporting means including a pair of support arms, each support arm being pivotally mounted to said supporting frame at a pivot point located laterally of the conveyor, said pivot points being vertically spaced from one another, and each support arm having a package supporting member spaced from its respective pivot point, said package supporting members being cooperatively positionable to support a package thereon;

means for pivoting said support arms, said support arms being pivotable to move said package supporting members laterally toward one another into package supporting disposition and being pivotable away from each other in a package release position to move said package supporting members laterally away from one another and thereby release a supported package onto the conveyor; and means for moving said package supporting means generally vertically on said supporting frame to said package release position for release of a supported package onto the conveyor and for moving said package supporting means subsequently upwardly away from the conveyor, both of said pivot points of said support arms being offset from the conveyor in the same lateral direction relative to the conveyor when said package supporting means is in said package release position and one of said package supporting members being disposed laterally further from the pivot point of the said support arm to which it is mounted than the other said package supporting member is from the pivot point of the said support arm, when said package supporting members are disposed in package supporting disposition.

2. In a textile winding machine, package transferring means according to claim 17 and characterized further in that said pivot points are disposed on the same vertical axis, and said support arms extend from said frame over the conveyor with one of said support arms being longer than the other to dispose said members in package supporting disposition over the conveyor.

3. In a textile winding machine, package transferring means according to claim 2 and characterized further in that said support arms extend at a downward inclination from said supporting frame to said package supporting members.

4. In a textile winding machine, package transferring means according to claim 3 and characterized further in that said support arms are connected to said pivoting means with the longer support arm being connected to the pivoting means above the connection of the other support arm to the pivoting means.

5. In a textile winding machine, package transferring means according to claim 2, 3 or 4 and characterized further in that said pivoting means pivots said longer support arm in a longer arc than the other support arm.

6. In a textile winding machine, package transferring means according to claims 1, 2, 3 or 4 and characterized further in that said means for oppositely pivoting includes a motor and a gear assembly driven by said motor.

7. In a textile winding machine, package transferring means according to claim 6 and characterized further in that said gear assembly includes a synchronization shaft connectable to the gear assembly of another package transferring means on said winding machine.

8. In a textile winding machine, package transferring means according to claim 6 and characterized further in that said gear assembly includes a gear coupled to each of said support arms and said gears are in meshing engagement with each other.

9. In a textile winding machine, package transferring means according to claims 1, 2, 3, or 4 and characterized further in that said supporting frame is disposed laterally outwardly of the conveyor with respect to the rear of the machine such that said support arms project laterally inwardly therefrom toward the rear of the machine.

10. In a textile winding machine, package transferring means according to claims 2, 3, 4 or 1 and characterized further by means for vertically moving said supporting frame.

11. In a textile winding machine, package transferring means according to claim 10 and characterized further by means for synchronously coupling said means for vertically moving with means for vertically moving of a supporting frame of another package transferring means on said winding machine.

12. In a textile winding machine, package transferring means according to claim 11 and characterized further in that said means for synchronously coupling includes an endless belt for coupling said vertically moving means to vertical moving means of another package transferring means for synchronous movement therewith.

13. In a textile winding machine, package transferring means according to claims 2, 3, 4 or 1 and characterized further in that the package conveyor is supported on a machine frame and said supporting frame is supported on said machine frame.

14. In a textile winding machine, package transferring means according to claim 1 and characterized further in that said package supporting members include a pair of rods.

15. In a textile winding machine, package transferring means according to claim 14 and characterized further in that said rods extend generally parallel to each other.

16. In a textile winding machine, package transferring means according to claim 1 and characterized further in that said means for oppositely pivoting includes means for sufficiently pivoting said arms clear of the package to avoid contact thereagainst during upward movement of said package supporting means.

* * * * *